US006876139B1

(12) United States Patent
Feldman

(10) Patent No.: US 6,876,139 B1
(45) Date of Patent: Apr. 5, 2005

(54) PARTITIONED FLAT FLUORESCENT LAMP

(75) Inventor: Alan Stuart Feldman, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/473,176

(22) Filed: Dec. 28, 1999

(51) Int. Cl.[7] ..... H01J 1/62; H01J 17/04

(52) U.S. Cl. ..... 313/493; 313/491; 313/494; 313/485; 313/581; 313/595; 313/514; 313/519

(58) Field of Search ..... 313/493, 491, 313/494, 485, 514, 519, 581, 595

(56) References Cited

U.S. PATENT DOCUMENTS

| | | | | |
|---|---|---|---|---|
| 2,265,323 A | | 12/1941 | Spanner | |
| 2,349,360 A | | 5/1944 | Marden et al. | |
| 2,802,968 A | | 8/1957 | Knott et al. | |
| 4,004,189 A | | 1/1977 | Cosco et al. | |
| 4,037,128 A | | 7/1977 | Levin et al. | |
| 4,978,888 A | * | 12/1990 | Anandan et al. | 315/58 |
| 5,220,249 A | | 6/1993 | Tsukada | |
| 5,343,116 A | | 8/1994 | Winsor | |
| 5,463,274 A | * | 10/1995 | Winsor | 313/493 |
| 5,602,444 A | * | 2/1997 | Jansma | 313/486 |
| 5,767,618 A | * | 6/1998 | Maya et al. | 313/493 |
| 5,818,164 A | | 10/1998 | Winsor | |
| 5,903,096 A | * | 5/1999 | Winsor | 313/493 |
| 5,914,560 A | | 6/1999 | Winsor | |
| 6,218,776 B1 | * | 4/2001 | Cull et al. | 313/493 |

FOREIGN PATENT DOCUMENTS

| | | | | |
|---|---|---|---|---|
| EP | 0913856 | | 5/1999 | |
| FR | 978563 | | 4/1951 | |
| FR | 2.156.260 | | 5/1973 | |
| FR | 2298882 | | 8/1976 | |
| GB | 326771 | | 3/1930 | |
| JP | 02276150 | | 11/1990 | |
| JP | 05242868 | | 9/1993 | |
| JP | 05 242868 | | 9/1993 | |
| JP | 06103962 | | 4/1994 | |
| JP | 06260144 | * | 9/1994 | H01J/61/30 |
| JP | 11250863 | | 9/1999 | |

* cited by examiner

*Primary Examiner*—Joseph Williams
*Assistant Examiner*—Sikha Roy

(57) ABSTRACT

A lamp includes an enclosure with partitions defining a channel having channel segments and/or providing multiple paths for an electrical arc to travel. The channel segments can be implemented by adding additional electrodes in the channel formed by the partitions, by forming a channel where the arc may travel in multiple directions, or by a combination of these methods. The channel segments and multiple directions of arc travel tend to reduce the voltage required to start the lamp.

11 Claims, 7 Drawing Sheets

PARTITIONED FLAT FLUORESCENT LAMP

BACKGROUND OF THE INVENTION

1. Technical Field

The present invention generally relates to lighting systems, and more particularly, to fluorescent lamps.

2. Background

Many industries and applications need backlighting for an information source. In particular, transmissive liquid crystal displays (LCDs) have become very popular in many electronic media. LCDs are useful in applications such as avionics, laptop computers, video cameras, and automatic teller machines. However, many LCDs require backlighting to illuminate the information being displayed.

Various systems perform the backlighting function in conventional displays. For example, one way to backlight an information source employs an array of conventional straight tubular fluorescent lamps. Low costs associated with such conventional lamps control costs, but they are sometimes inadequate for particular applications. For instance, in avionics applications, the poor color quality of the phosphors and the short lamp life of conventional lamps, among other shortcomings, limit their usefulness.

To avoid the various problems with conventional lamps, many manufacturers employ customized lamps, such as tubular serpentine lamps. Unlike conventional fluorescent lamp arrays, custom-made serpentine lamps commonly provide good color characteristics, high luminance uniformity, and long lamp life. These lamps are typically hand made, and consequently, are comparatively costly. Moreover, these lamps are extremely fragile and difficult to install. Additionally, to optimize the light output, conventional serpentine backlight systems include a diffuser and reflective cavity, adding further cost to the overall information source. Therefore, while custom-made tubular serpentine lamps may meet certain standards for the backlighting function, the high cost and fragility detract from the advantages they offer.

A third alternative for backlighting information sources is flat fluorescent lamps. An exemplary flat fluorescent lamp described in U.S. Pat. No. 5,343,116, issued Aug. 30, 1994, to Winsor, comprises a substrate fritted to a transparent cover lid, forming an enclosure. Diffuse channels are formed into the substrate in the interior of the enclosure. Standard phosphors are added to the interior of the enclosure which is further flushed with a material for emitting energy, such as argon or mercury. Energy is emitted in the form of visible light when an electric potential is introduced to the lamp by two electrodes, with one electrode placed at each end of the diffuse channel. Plasma or other emissive material is ignited through sparking caused by the electric potential between the two electrodes. Such lamps offer ruggedness and lower manufacturing costs than serpentine tubular lamp alternatives.

However, the serpentine channel in these flat lamps is difficult to use in its optimal configuration. To achieve the desired light output without putting undue thermal stress on the lamp, the channel needs to be reduced in width and depth. As the surface area of the lamp must remain constant, the length of the channel needs to be increased to compensate for the reduction in width and depth.

This increased channel length requires a significantly higher voltage to achieve lamp ignition. When the electrodes spark the emissive material, it creates an arc that travels in one direction and has one ignition segment. The longer the diffuse channel, the longer the arc has to travel, and consequently, the greater the voltage that is needed to start the lamp. Due to the large voltage required to start conventional serpentine flat fluorescent lamps, the electronics that are required to perform that function can be costly, especially in applications having little space to spare for physically large power sources.

SUMMARY OF THE INVENTION

A lamp according to various aspects of the present invention comprises a channel having multiple channel segments and multiple electrodes. An enclosure that has an interior portion contains a fluorescent material and a material for emitting energy in response to an electric potential. The channel segments may be formed in any suitable manner, such as by adding at least one additional electrode at some point in the channel to define smaller conjoined channel segments, such that multiple channel segments share at least one common electrode. In another embodiment, the lamp includes multiple channel segments configured so that the arc has at least two directions to travel, which may be implemented by creating parallel channel segments sharing at least two common electrodes.

BRIEF DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the claims and the accompanying drawings, in which like parts may be referred to by like numerals:

DETAILED DESCRIPTION OF THE PREFERRED EXEMPLARY EMBODIMENTS

The ensuing descriptions are preferred exemplary embodiments only, and are not intended to limit the scope, applicability, or configuration of the invention in any way. Rather, the ensuing descriptions provide a convenient description for implementing a preferred embodiment of the invention, it being understood that various changes may be made in the function and arrangement of elements described in the preferred embodiments without departing from the spirit and scope of the invention as set forth in the appended claims.

Figure 1:
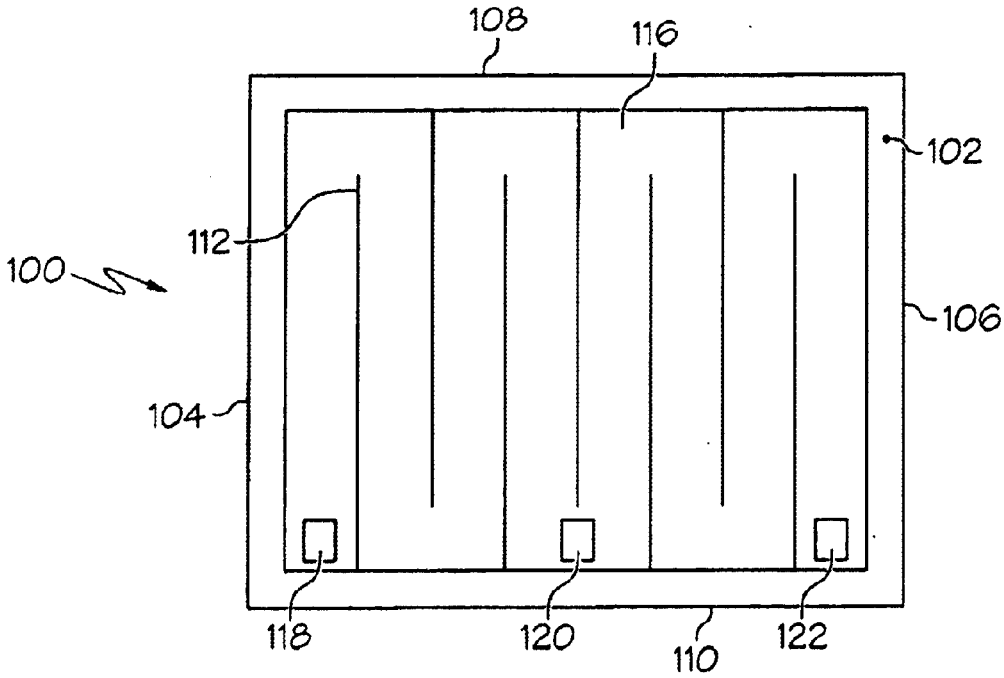
FIG. 1 is a plan view of a flat fluorescent lamp in accordance with the present invention.
Figure 2:
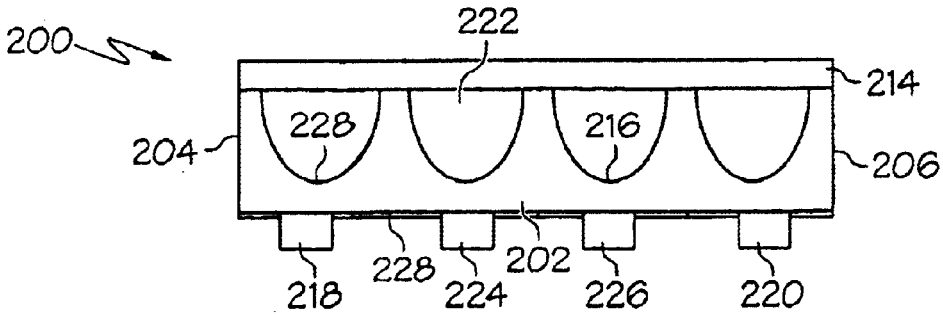
FIG. 2 is a cross-sectional view of a flat fluorescent lamp in accordance with the present invention.

Referring now to FIGS. 1 and 2, a flat fluorescent lamp 100 according to various aspects of the present invention includes a substrate 102, a cover lid 214, and a set of electrodes 218, 220, 224, 226. The substrate 102 comprises any suitable base for cooperating with the cover lid 214 to form an enclosure. In the present embodiment, the substrate 102 suitably includes two sidewalls 104 and 106 and two end walls 108 and 110 forming a rectangular perimeter. The substrate 102 may conform, however, to any appropriate shape based on relevant criteria, such as the shape of the display, space limitations, and the like. Substrate 102 is formed of any suitable material that is, preferably, rigid and self-supporting, such as glass or ceramic. A diffuse channel 116 is suitably formed by extending at least one channel wall 112 from the bottom of substrate 102 to substantially meet cover lid 214. The diffuse channel may be formed by milling, molding, or any other appropriate method. In the present embodiment, channel walls 112 extend in one direction and then alternate to the other direction so that a continuous channel is formed within substrate 102 from one corner to another. The channel walls 112 may be constructed, however, in any manner to create a diffuse channel having a suitable configuration in the lamp 100.

Diffuse channel 116 may have a variety of cross-sectional configurations which may optionally be altered for different applications. Conventional flat fluorescent lamps have a "U-like" cross-sectional shape, as seen in FIG. 2, where the upper portions of the channel walls are straight or taper outward so that the top of the channel is wider than the bottom of the channel. However, the channel walls may also be constructed so that the walls taper inward, which results in the selective angular tuning of emitted light into a more intense cone of viewable light without requiring a greater power input. Additionally, the channels may optionally be milled so that they are either symmetrical or asymmetrical in cross-sectional shape. Generally, the cross-sectional shape may be altered depending upon the backlighting application for which the lamp is being employed.

As seen in FIGS. 1 and 2, the lid 214 is suitably attached, for example, by fritting the lid 214 to substrate 102 such that the lid 214 and the top portion of sidewalls 104 and 106, end walls 108 and 110, and channel walls 112 form an enclosure within lamp 100. The enclosure suitably includes a seal to maintain near-vacuum conditions inside the lamp 100. The lid 214 is preferably constructed of a substantially transparent or translucent material, preferably having a coefficient of thermal expansion that substantially matches that of substrate 102. In the present embodiment, the lid 214 suitably comprises glass.

At least a portion of the enclosure interior is coated with a material through painting, spraying, or any other appropriate technique. The applied material fluoresces in the visible spectrum under selected circumstances, such as when bombarded with ultraviolet radiation. In the present embodiment, the fluorescent material may be a phosphor, and more particularly, a rare earth phosphor. The interior portion of the lid 214 may also optionally be at least partially covered with the fluorescent material. In the present embodiment, the area of the lid 214 that substantially meets the tops of the channel walls is not coated with the fluorescent material. An activation material, such as an ultraviolet emissive material like a plasma, mercury, or argon, or another suitable activation material for selectably causing the fluorescent material to fluoresce, is placed in the enclosure.

The electrodes such as the electrodes 218, 220, 224, 226, spark the emissive material. The electrodes 218 220, 224, 226 may be configured in any appropriate manner to effectively activate the activation material and/or the fluorescent material. The electrodes may be disposed in a housing. The housing is suitably configured to physically and electrically isolate the electrode from the lamp exterior and place the electrode in electrical contact with the activation material and/or the fluorescent material. The housing may be further configured to optimize the light provided. For example, the housing may be configured as described in U.S. Pat. No. 5,818,164, issued Oct. 6, 1998, to Winsor.

In the present embodiment, housing suitably houses at least one electrode, such as a filament wire (not shown), with each electrode extending into lamp 200 for exciting the activation material and/or the fluorescent material. The housings are suitably located on the bottom exterior of the substrate 202. The housings suitably comprise glass bodies containing the filaments and affixed to the lamp body, such as with a glass frit. The glass frit suitably exhibits a lower melting point than that of the housing. The attachment of the housings 118, 120, 122, which are suitably soldered to the bottom exterior of substrate 102 with the filament wires in place, can have a variety of configurations as to their location and attachment. The lamp 300 suitably includes multiple electrodes, each disposed within a housing, for sparking the lamp. The electrodes may comprise any appropriate electrode for sparking the activation material and/or the fluorescent material. Further, the electrodes may be powered by AC or DC power, by one or multiple power sources, at a variety of frequencies or amplitudes, as well as any other appropriate method.

Figure 3:
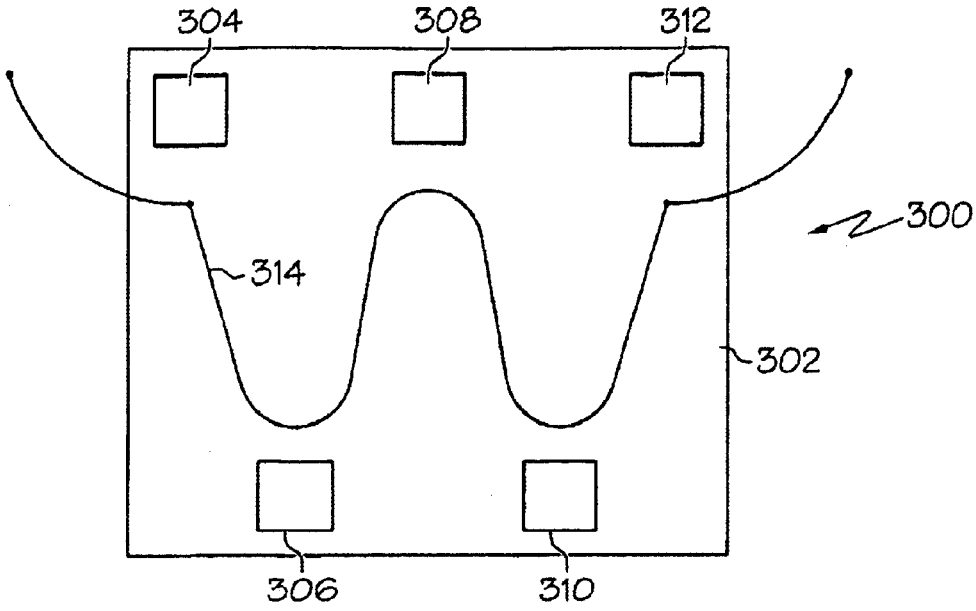
FIG. 3 is a rear view of a flat fluorescent lamp in accordance with a preferred exemplary embodiment of the present invention.

FIG. 3 illustrates a rear view of the flat fluorescent lamp 300 having multiple electrodes 304, 306, 308, 310, and 312. This configuration of electrodes is merely illustrative of one configuration according to various aspects of the present invention, any number of additional electrodes or reconfiguration of the electrodes may be provided. Additionally, the lamp may optionally also have a network of heating strips 314 affixed to the rear of the lamp. These heating strips assist in heating the flat fluorescent lamp, as well as providing a ground plane or start strip for the lamp. A metal covering (not shown) may also optionally be placed around the base of the flat fluorescent lamp to act as a heat sink.

A flat lamp according to various aspects of the present invention includes a channel 116 partitioned into multiple channel segments by multiple electrodes. Each of the multiple channel segments is shorter than the total length of the channel 116. Each channel segment comprises at least a portion of the channel 116 and is defined by at least two ends. The channel segments are further defined by at least two electrodes, suitably placed at each end of the channel segments. Each electrode for a particular segment electrically connects to a different voltage potential to create a voltage difference across the length of the segment between the electrodes. For example, in a DC configuration, one electrode maybe connected to a voltage source and the other electrode may be connected to ground. In an AC configuration, the electrodes are supplied with varying voltages. Because each segment is shorter than the total length of the channel 116, the applied voltage required to activate the activation material and/or the fluorescent material within the segment is less than the voltage required to spark the entire length of the channel 116.

Figure 4:
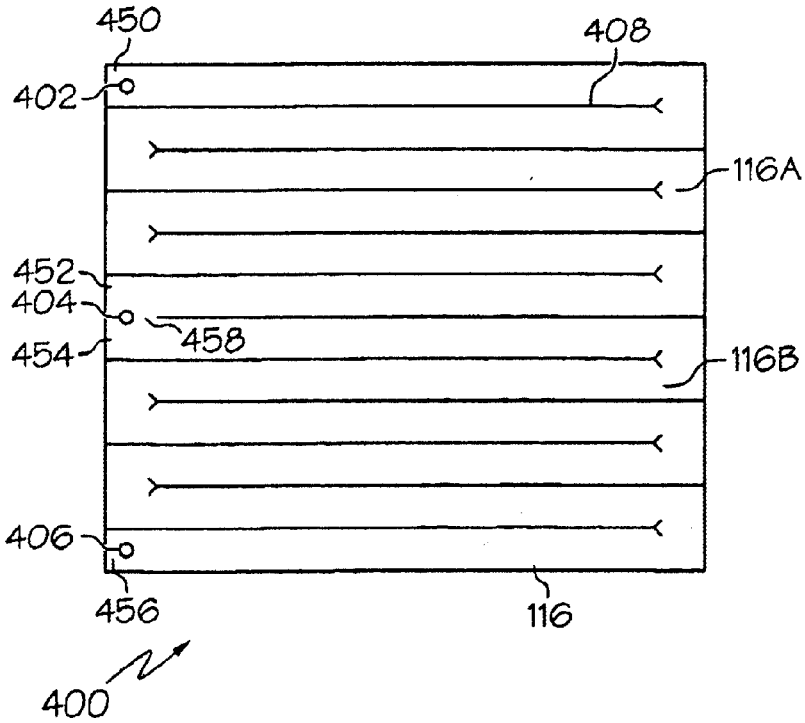
FIG. 4 is top plan view of a flat fluorescent lamp in accordance with the present invention having flares at the end of the channel walls.

A flat fluorescent lamp according to various aspects of the present invention, shown in FIG. 4, includes a partitioned channel 116 having at least two channel segments 116A, 116B. Each channel segment is suitably approximately equal in length. In this embodiment, channel walls 408 are optionally flared at the ends to assist in optimizing light uniformity. Three electrodes 402, 404, and 406 define the two conjoined channel segments 116A, B. The electrodes 402, 404, 406 are positioned at the ends 450, 452, 454, 456 of the channel segments. In the present embodiment, the end 452 of the first channel segment 116A and the end 454 of the second channel segment 116B substantially coincide in a common electrode area 458. The two channel segments 116A, 116B share a common electrode 404 disposed in the common electrode area 458, which comprises the area surrounding the common electrode. The common electrode 404 suitably comprises any electrode which operates in conjunction with more than one channel segment.

In operation, the end electrodes 402, 406 are suitably connected to identical voltages, while the common electrode 404 is connected to a different voltage. Consequently, a substantially identical voltage potential forms from each end electrode 402, 406 across each channel segment 116A, B to common electrode 404. The electrodes 402, 404, 406 may be powered by the same source, or may be powered by different sources, or may be powered in any suitable manner. The two segments 116A, B spark at lower voltages than the voltages required to spark the full channel 116.

Figure 5:
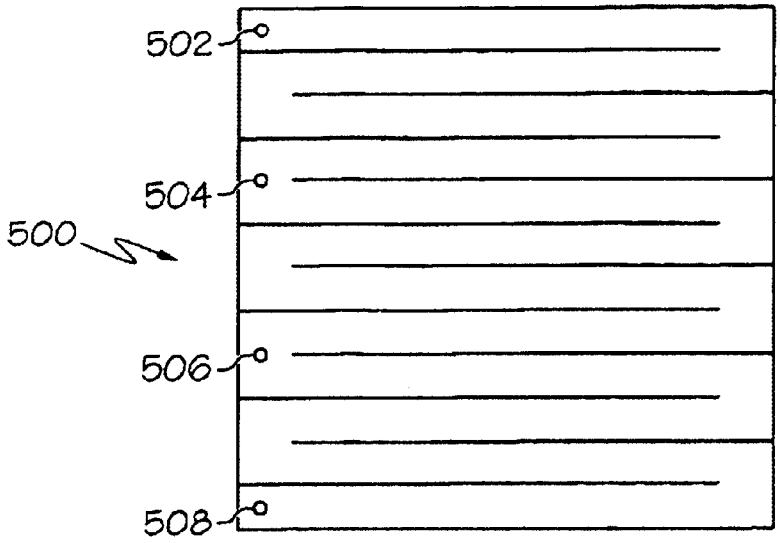
FIGS. 5–8 are top plan views of further examples of flat fluorescent lamps in accordance with the present invention having conjoined ignition segment configurations.
Figure 6:
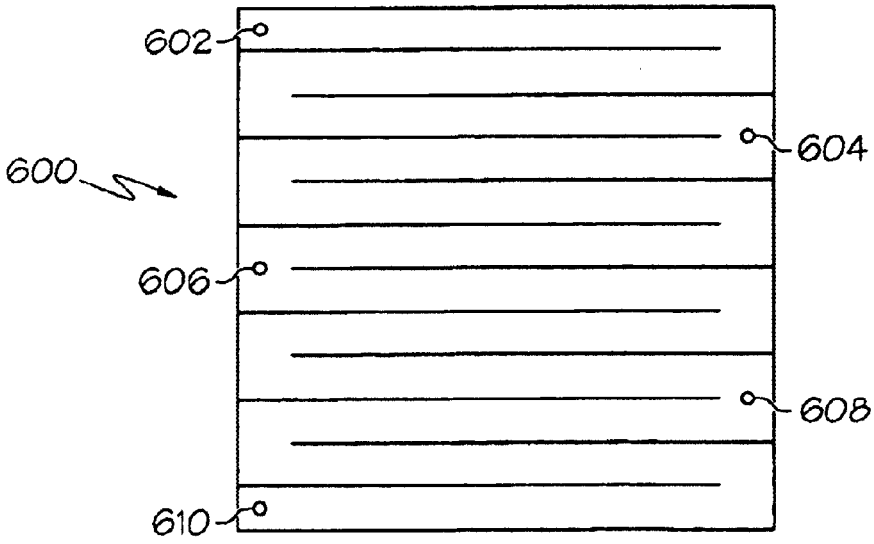
Figure 7:
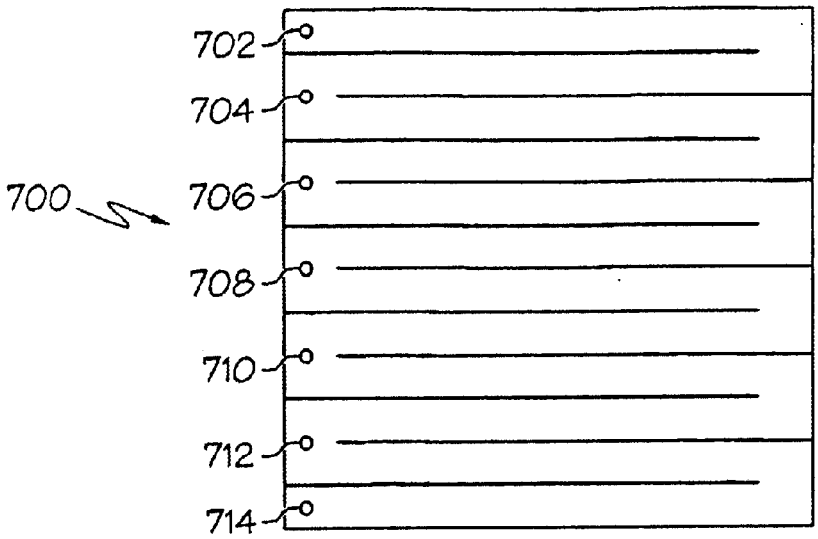
Figure 8:
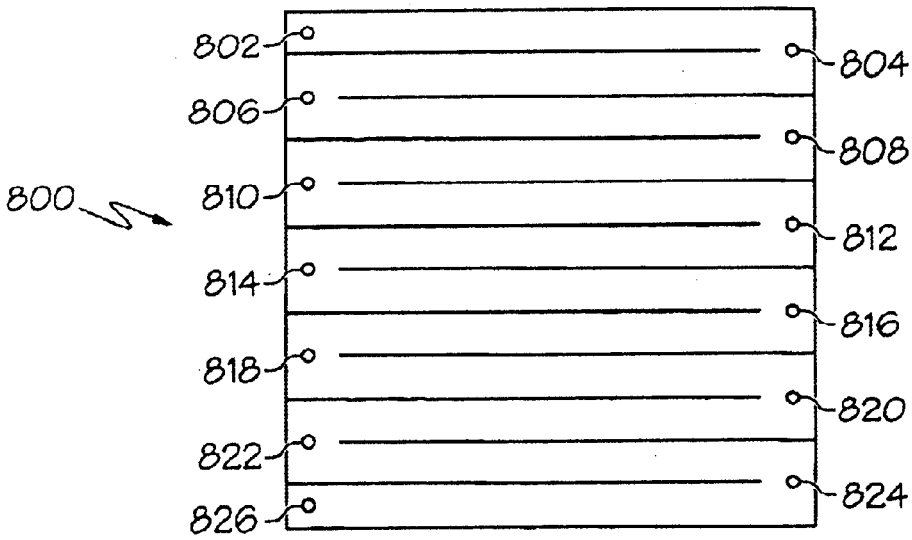

The channel 116 may be divided into channel segments in any suitable manner and configuration. Various electrode configurations facilitate limitless configurations for partitioning the channel 116. For example, FIGS. 5–8 show further exemplary embodiments of flat fluorescent lamps according to various aspects of the present invention having a series of suitably charged electrodes to define channel segments. FIG. 5 shows an embodiment wherein the lamp 500 has four electrodes of alternating positive and negative charge 502, 504, 506 and 508 on the same side of the lamp, forming three conjoined channel segments. The exemplary embodiment of FIG. 6 has five electrodes of alternating positive and negative charge 602, 604, 608, 610, and 612 on alternating sides of the lamp 600. This creates four conjoined lamp segments. FIG. 7 shows an exemplary embodiment of the present invention having seven electrodes of alternating charge 702, 704, 706, 708, 710, 712, and 714, all on the same side of the lamp 700. The five extra electrodes 704, 706, 708, 710, and 712 create six conjoined channel segments. FIG. 8 shows a further embodiment having thirteen electrodes of alternating charge 802, 804, 806, 808, 810, 812, 814, 816, 818, 820, 822, 824, and 826 on both sides of the lamp 800: This addition of electrodes 804–824 creates a lamp with 12 conjoined channel segments. Each of the above configurations creates channel segments that are significantly shorter than the length of the full channel, tending to facilitate lower starting voltages. The present invention is not limited to the embodiments described above; these embodiments are merely illustrative of the variety of configurations available.

In other embodiments, more than one electrode may be associated with multiple parallel channels by forming the serpentine channel to have more than one direction for the arc to travel. Exemplary embodiments of this type of configuration are shown in FIGS. 9–12. Additionally, parallel channels may be combined with another channels in series, such as the configurations illustrated in FIGS. 13 and 14.

Figure 9:
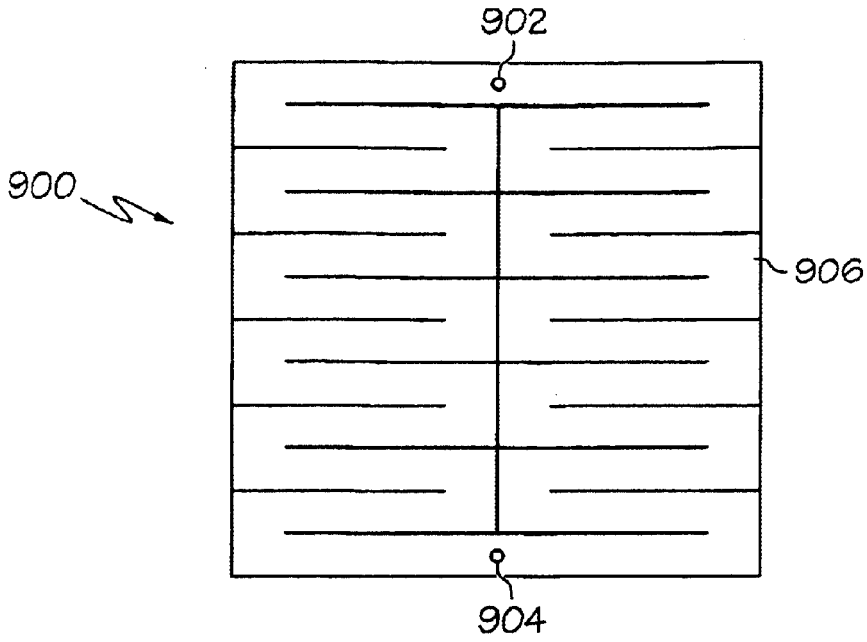
FIGS. 9–12 are top plan views of examples of flat fluorescent lamps in accordance with the present invention having parallel ignition segment configurations.

Referring now to FIG. 9, lamp 900 according to an exemplary embodiment has serpentine channels in parallel configuration each channel comprising plurality of channel segments configured in series with one another. The voltage potential applied by electrodes 902 and 904 propagates in two directions, such that the diffused channel is divided into two channels. This configuration reduces the starting voltage of the lamp relative to conventional systems. By forming the diffuse channel with plurality of channels in a parallel configuration, two shorter ignition segments are formed without requiring the addition of any electrodes.

Figure 10:
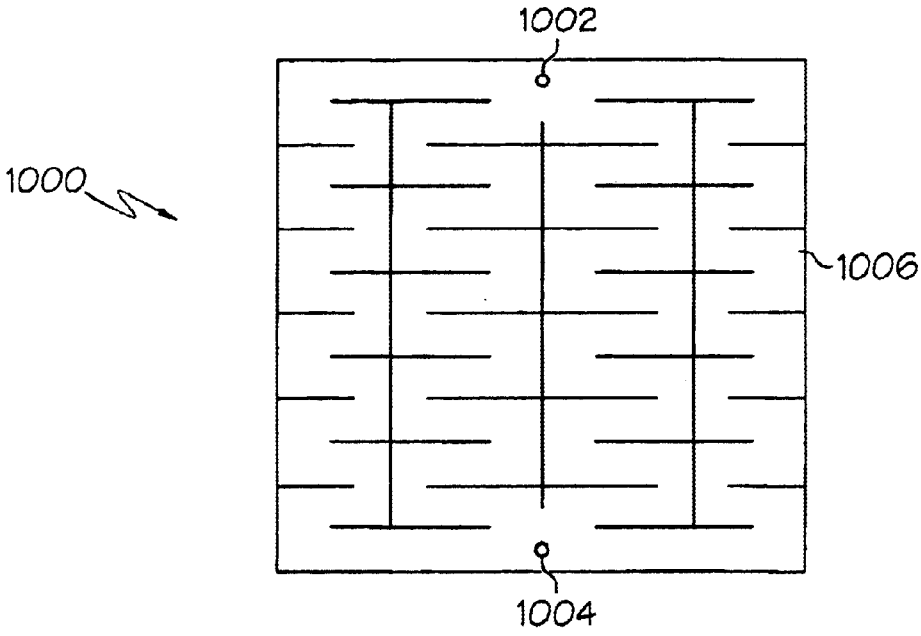

Similarly, as shown in FIG. 10, an alternative lamp 1000 suitably includes four ignition segments in a diffuse channel 1006 formed so that the four serpentine channels are in a parallel configuration. When electrodes 1002 and 1004 charge, the arc travels through all four paths.

Figure 11:
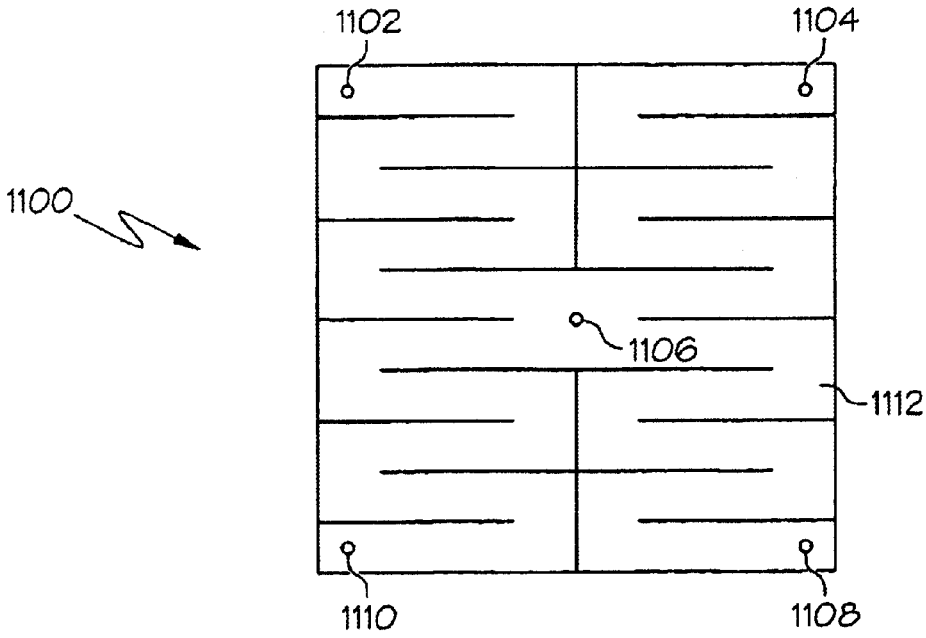
Figure 12:
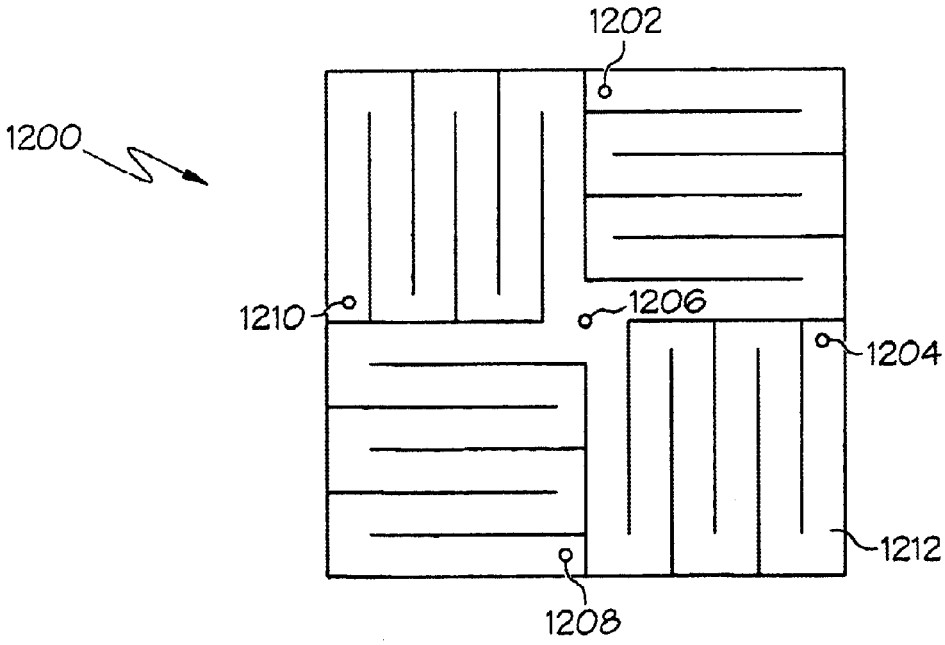

FIGS. 11 and 12 show two further exemplary lamps according to various aspects of the present invention. Lamp 1100 of FIG. 11 has electrodes 1102, 1104, 1106, 1108, and 1110, which cause the arc to travel through the four parallel channels of diffuse channel 1112. Electrodes 1102, 1104, 1108, and 1110 are all suitably charged with a first voltage level, while electrode 1106 is suitably charged at a different level. For example, electrodes 102, 1104, 1108, and 1110 may be negatively charged while electrode 1106 is positively charged. Lamp 1200 of FIG. 12 similarly exhibits four parallel channels. Outer electrodes 1202, 1204, 1208, and 1210 are charged at a first voltage and inner electrode 1206 is charged at a second voltage. Diffuse channel 1212 may be formed with any number of channels and any appropriate number and configuration of electrodes.

Figure 13:
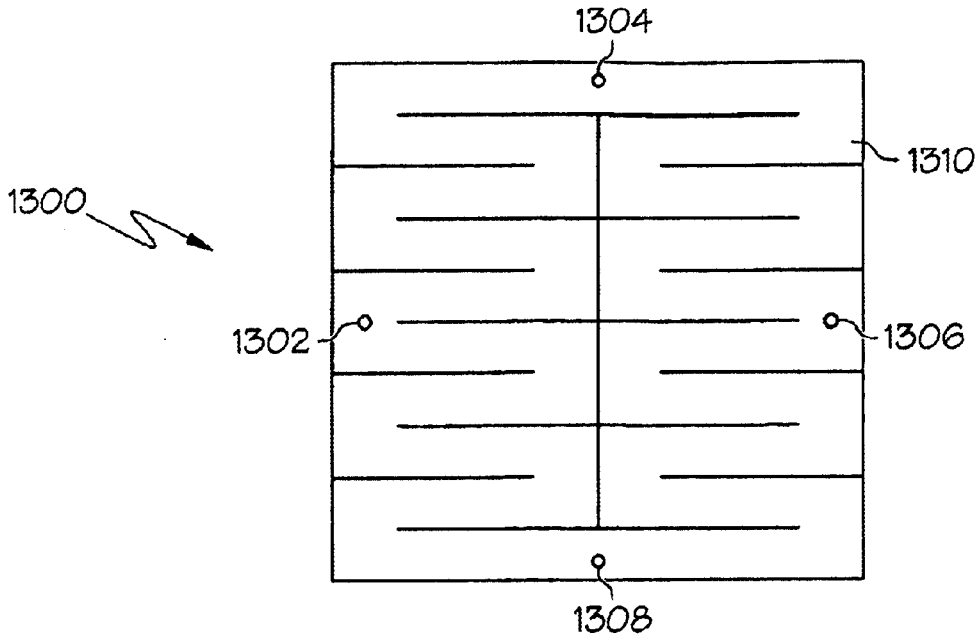
FIGS. 13 and 14 are top plan views of flat fluorescent lamps in accordance with the present invention having combined conjoined/parallel configurations.
Figure 14:
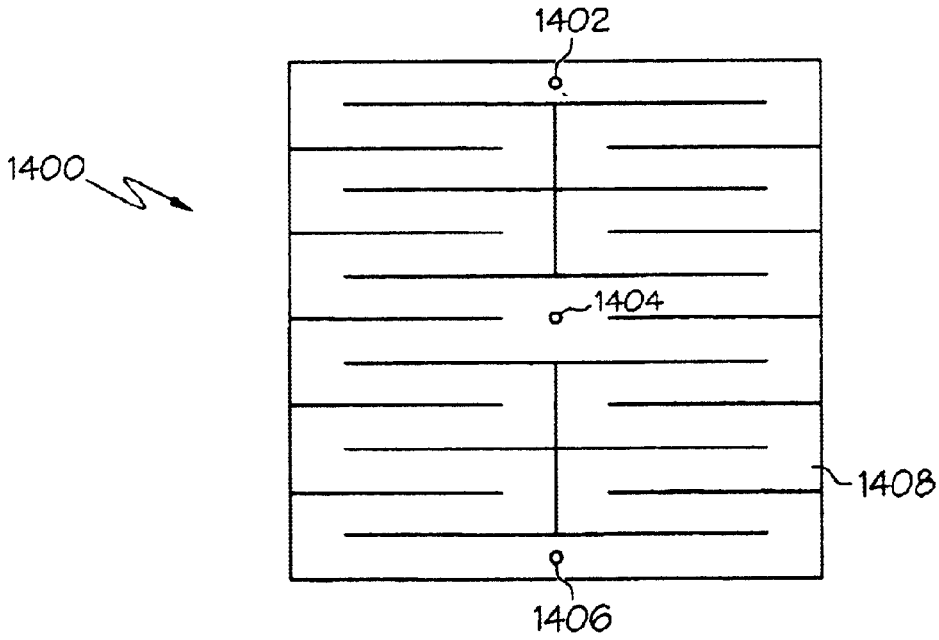

Referring to FIGS. 13 and 14, an alternative lamp configuration suitably represents a hybrid of the series and parallel configurations. For example, lamp 1300 of FIG. 13 has multiple, such as four electrodes 1302, 1304, 1306, and 1308, which are charged at appropriate voltages to form potentials across the various segments. For example, two electrodes 1302, 1306 may be positively charged while two other electrodes 1304, 1308 are negatively charged. In this configuration, diffuse channel 1310 comprises two sets of two conjoined channels in a parallel formation. Similarly, an alternative lamp 1400 of FIG. 14 has alternating positive and negative electrodes 1402, 1404, and 1406, arranged in a diffuse channel 1408 comprising two conjoined sets of two parallel channels.

In all embodiments of the inventions, a reflective material, such as aluminum or ceramics, may further enhance the flat fluorescent lamp's perceived brightness. The reflective material may be applied in any suitable configuration. For example, referring to FIG. 2, the reflective material 228 may be applied to the bottom exterior of substrate 202 to redirect light that would have been rear-emitted. Additionally, reflective material 228 may be placed in the interior of the lamp for redirecting light forward to be emitted as viewable light through cover lid 214. Reflective material 228 may be applied to the entire interior surface or may be applied to only a portion of the enclosure interior to yield a masking effect.

Additional materials may be included to enhance lamp performance. For example, a semi-transparent layer may also be applied to at least some portion of the interior of the enclosure in FIG. 2 (e.g., at layer 228 or along inner surface of 214) to prevent ultraviolet emissive material migration into the fluorescent material or into the matrix of substrate. The semi-transparent layer can be any suitable material, such as an aluminum oxide, which tends to extend the useful life of the lamp. Thus, additional materials for enhancing the lamp's brightness and life may be used for reducing the starting voltage, extending the life of the lamp, or achieving other design characteristics.

Thus, a flat fluorescent lamp according to various aspects of the present invention provides several features and advantages, such as a reduced starting voltage. In addition, the above descriptions are preferred exemplary embodiments only, and are not intended to be limiting in any way. Various modifications, substitutions, and other applications of the present embodiments may be made without departing from the spirit and the scope of the invention as set forth in the appended claims.

What is claimed is:

1. A lamp comprising:

a substrate having a plurality of channels formed therein, each channel having at least a first end and a second end and configured in parallel with at least one other of the plurality of channels, each channel comprising a plurality of adjacent channel segments configured in series with one another, each channel segment having at least a first end and a second end and configured to emit light in response to an activation voltage being applied between the first and second ends of the channels and a plurality of activation electrodes coupled to the channel and adapted to couple to a lamp activation power supply, wherein:

(i) each of the channel segments shares an end with another channel segment (ii) at least one activation electrode is coupled to each end of the channel and (iii) at least one activation electrode is coupled to each common electrode area.

2. The lamp of claim 1, wherein an activation voltage potential of equal magnitude is applied between each of the channel's first and second ends.

3. The lamp of claim 1, further comprising:

a plurality of sidewalls coupled to the substrate; and a lid coupled to each sidewall to form an enclosure having an interior surface.

4. The lamp of claim 3, further comprising:

a reflective material applied to at least a portion of the enclosure interior surface.

5. The lamp of claim 4, wherein the reflective material comprises at least one of aluminum and ceramic.

6. The lamp of claim 3, further comprising:

a fluorescent material disposed within the enclosure.

7. The lamp of claim 1, wherein the channel is serpentine in shape.

8. The lamp of claim 1, wherein the lamp is configured as a flat lamp.

9. The lamp of claim 1, wherein at least a portion of the channel has an asymmetrical cross-section.

10. The lamp of claim 1, wherein:

each channel comprises n conjoined channel segments; and n is greater than two.

11. In a lamp including a substrate having a plurality of channels formed therein, each channel having at least a first end and a second end and configured in parallel with at least one other of the plurality of channels, each channel comprising a plurality of adjacent channel segments configured in series with one another, each channel segment having at least a first end and a second end and configured to emit light in response to an activation voltage being applied between the first and second ends of the channel, a method of starting and operating a lamp comprising the steps of:

applying an activation voltage of a magnitude between the first and second ends of each of the channel in each of the plurality of parallel-configured channels, wherein the magnitude of the activation voltage applied between each channel's first and second end is substantially equal.

* * * * *